United States Patent [19]

Ewald

[11] 4,013,197

[45] Mar. 22, 1977

[54] DOUBLE SEAL VALVE STEM

[75] Inventor: Ronald F. Ewald, Rolling Meadows, Ill.

[73] Assignee: Seaquist Valve Company, Div. of Pittway Corporation, Cary, Ill.

[22] Filed: Sept. 10, 1975

[21] Appl. No.: 611,862

Related U.S. Application Data

[63] Continuation of Ser. No. 264,204, June 19, 1972, abandoned.

[52] U.S. Cl. ..... 222/402.24; 251/353

[51] Int. Cl.[2] ..... B65D 83/14

[58] Field of Search ..... 222/402.24, 148, 402.12, 222/512, 518, 542, 402.22; 251/303, 347–349, 353, 354

[56] References Cited

UNITED STATES PATENTS

| | | | |
|---|---|---|---|
| 3,121,517 | 2/1964 | Geary et al. | 222/402.24 |
| 3,128,924 | 4/1964 | Gorman | 222/518 X |
| 3,383,157 | 5/1968 | Goldhirsh | 222/402.24 X |
| 3,499,584 | 3/1970 | Warren | 222/402.24 X |
| 3,615,042 | 10/1971 | Marand | 222/402.24 X |
| 3,647,121 | 3/1972 | Ayres | 222/402.24 |

*Primary Examiner*—Robert B. Reeves
*Assistant Examiner*—Francis J. Bartuska
*Attorney, Agent, or Firm*—Stefan M. Stein

[57] ABSTRACT

A double seal valve stem comprising a substantially tubular elongated upper portion having a cylindrically shaped cavity communicating with at least one dispensing port extending through the side wall thereof and an enlarged substantially cylindrical lower portion including an annular beveled upper portion to form an annular groove therebetween such that when operatively assembled within an aerosol dispenser the side wall of the upper portion and the beveled surface of the lower portion seal against a sealing ring gasket arranged in the turret of the mounting to form a double seal.

6 Claims, 8 Drawing Figures

FIG. 1
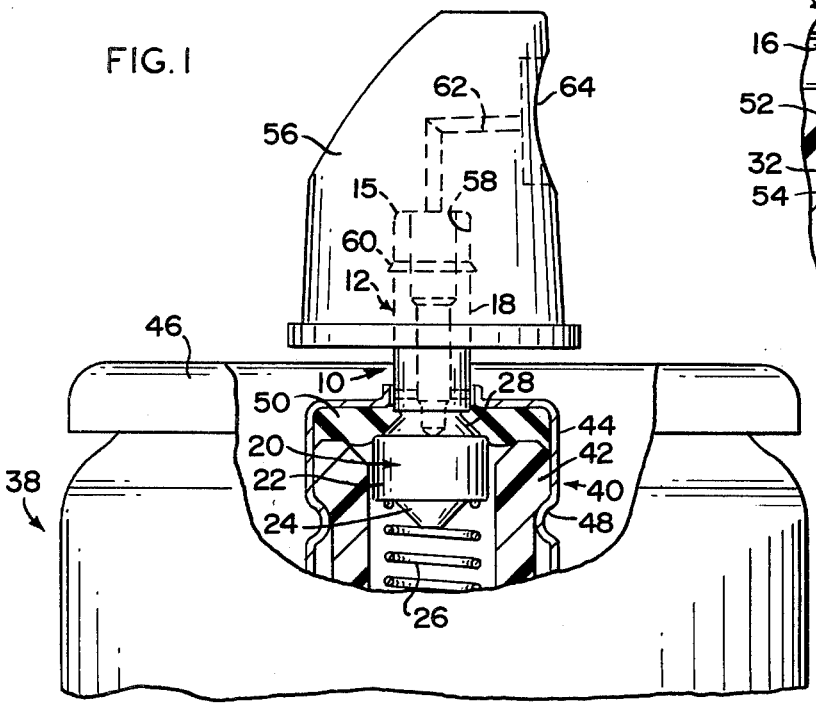
FIG. 5
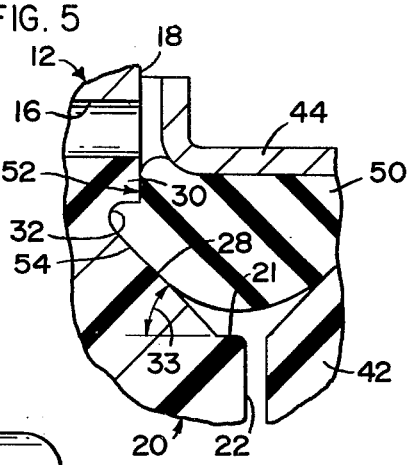
FIG. 6
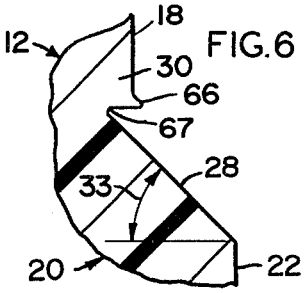
FIG. 7
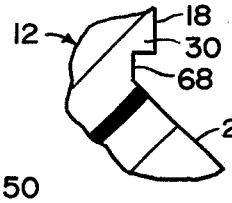
FIG. 2
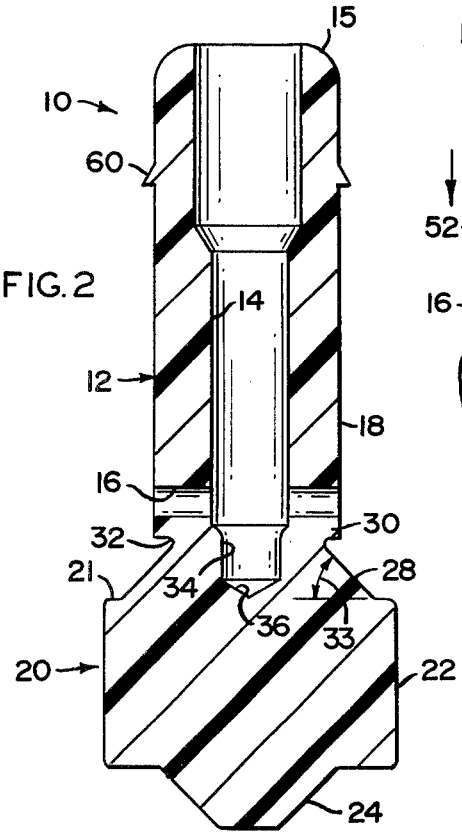
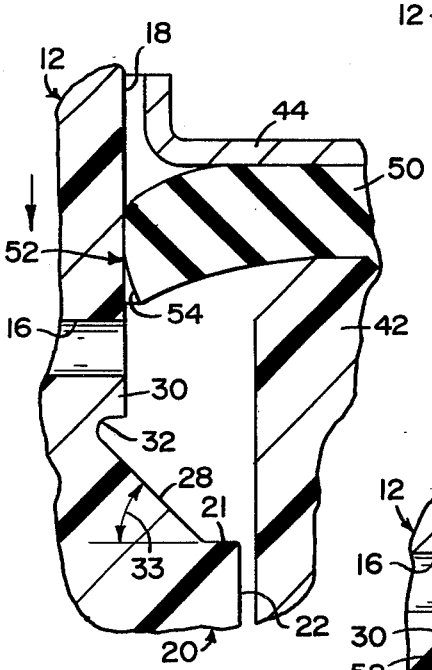
FIG. 3
FIG. 8
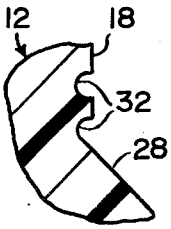
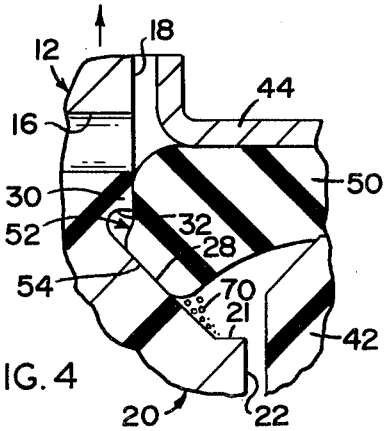
FIG. 4

DOUBLE SEAL VALVE STEM

This application is a continuation of Ser. No. 264,204, filed June 19, 1972, now abandoned.

BACKGROUND OF THE INVENTION

1. Field of the Invention

This invention relates to a valve stem having a tubular upper portion and a cylindrical lower portion having a beveled upper surface terminating at the base of the tubular upper portion to form an annular groove therebetween such that the side wall of the upper portion and the beveled surface of the lower portion form two separate sealing surfaces.

2. Description of the Prior Art

Valve assemblies for aerosol dispensers generally comprise a hollow valve body having a spring biased valve stem disposed therein.

Commonly, these valve stems comprise a hollow tubular body closed at the lower extreme and including a dispensing port formed in the side wall thereof. Normally the valve stem is biased in the closed position where the dispensing port abuts a gasket type sealing ring disposed in the mounting cup turret to prevent product or propellant from flowing therethrough.

Another common valve stem configuration comprises a solid inverted mushroom shaped member wherein the sealing means is disposed between the mushroom head and the lower surface on the valve body. Thus, as the stem is depressed into the valve body, the seal between the mushroom head and the body is broken releasing the contents from within the dispenser.

Generally, the efficiency and efficacy of these seals has been satisfactory for most liquid products. However, with the increasing use of solid products such as powder and the like, these seals have been found to be less effective. The solid particles tend to become lodged between the sealing surfaces thereby reducing the seal therebetween thus permitting the propellant and/or product to escape when the dispenser is not actuated. Obviously, this is unacceptable from a consumer standpoint.

Thus, it is apparent that a need exists for an effective seal that is within reasonable cost and production parameters.

SUMMARY OF THE INVENTION

This invention relates to a double seal cleaning action valve stem. More specifically, the invention comprises a tubular valve stem with an enlarged closed lower end. The cavity of the tubular valve stem extends into the upper part of the enlarged lower end and comprises a product residue receiving chamber. At least one dispensing port is formed in the lower side wall of the valve system.

The enlarged closed end has an annular beveled upper surface. An annular groove is formed at the juncture of the upper surface and the base of the tubular upper portion of the valve stem.

A frustum shaped protrusion extending downward from the base of the enlarged lower end forms a seat to operatively engage a biasing spring disposed within the valve body. When the valve stem is operatively assembled with a valve body and aerosol dispenser, the side wall of the tubular upper portion and the beveled surface of the enlarged lower end seal against a sealing ring gasket usually arranged in the turret of the mounting cap forming a double seal. It should be noted that the discharge port is disposed above the sealing ring gasket when the valve assembly is in the closed or biased position.

As the valve button and valve stem are depressed, the sealing ring gasket flexes downward wiping the discharge port and side wall of the tubular upper portion clean. Once below the sealing ring gasket, the product discharge port communicates with the interior of the dispenser permitting product to flow through the discharge port, cylindrical cavity and valve button into the atmosphere.

Upon release of the valve button, the valve stem moves upward causing the inner annular wall of the sealing ring gasket to wipe the side wall thereof and the discharge orifice clean of any product residue. This cleaning action is particularly beneficial when dispensing a powder product. If any residue remains on the sealing surfaces the device will tend to leak. In the closed or sealed position, the inner annular wall of sealing ring gasket sealingly engages the side wall of the valve stem below the discharge orifice thereby preventing any leakage. At the same time, the upward pressure of the beveled surface presses against the bottom of the sealing ring gasket to form a second seal therebetween as well as forces the lower portion of the sealing ring gasket into the annular groove further sealing the interior of the dispenser from the surrounding atmosphere. Since the sealing ring gasket must wipe the residue from the valve stem as well as seal in the annular groove a medium durometer gasket is preferable.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the invention, reference should be had to the following detailed description taken in connection with accompanying drawings which:

FIG. 1 is a cross-sectional view of the double seal cleaning action valve stem mounted in an aerosol dispenser.

FIG. 2 is a detailed cross-sectional view of the double seal cleaning action valve stem.

FIG. 3 is a partial cross-sectional view of the double seal cleaning action valve stem in the "actuated" position.

FIG. 4 is a partial cross-sectional view showing the double valve stem "cleaning" action.

FIG. 5 is a partial cross-sectional view of the double valve stem and sealing ring gasket sealed.

FIGS. 6 through 8 are partial cross-sectional views of alternate embodiments of the groove for varying the sealing effect of the double valve stem.

Similar reference characters refer to similar parts throughout the several views of the drawings.

DETAILED DESCRIPTION OF THE PREFERRED EMBODIMENT

As shown in FIG. 1 and 2, the present invention comprises a double seal valve stem 10 including a substantially tubular elongated upper portion 12 having a cylindrically shaped cavity 14 extending from the top 15 thereof. At least one dispensing port 16 extends through the sidewall 18 of the tubular upper portions 12 into cavity 14.

The lower portion 20 of the stem 10 comprises an enlarged substantially cylindrical base 22 having a frustum shaped protrusion 24 extending from the bottom thereof to form a seat for valve stem biasing means which is preferably a helical spring, such as the spring 26 shown in FIG. 1. The enlarged lower portion 20 includes an annular beveled upper surface 28 extending inwardly from annular ledge 21 and terminating at the base 30 of the tubular upper portion 12 to form an annular groove 32 therebetween. In the embodiment shown in FIGS. 2 and 3, this annular groove 32 has a substantially U-shaped cross-section.

The closed lower end 34 of the cavity 14 extends into the lower portion 20 to form a residue receiving chamber 36.

FIG. 1 shows, in detail, a complete aerosol dispenser 38 and valve assembly 40 with the double seal valve stem 10 of this invention affixed thereto. The valve assembly 40 includes a tubular valve body 42 which is fixedly secured within a turret 44 of a mounting cup 46, by crimping the turret 44 at 48. The valve stem 10 extends through the top of the turret 44, and is biased in a raised position by means of the spring 26, disposed beneath the valve stem 10 within the valve body 42. A sealing means, generally in the form of a resilient sealing ring gasket 50, is disposed in the top of the turret 44. The valve stem 10 passes through aperture 52 formed in the sealing ring gasket 50. When in its normally raised position, the sidewall 18 seals against the inner annular wall 54 of aperture 52 below dispensing port 16. Further, the beveled surface 28 forms a seal with the underside of the sealing ring gasket 50. In addition, sealing ledge 21 and beveled surface 28 force the sealing ring gasket 50 into groove 32.

The valve button 56 is affixed to the aerosol valve, by slipping the valve stem 10 into the valve stem receiving cavity 58 formed in it. For this reason, the cavity 58 is preferably sufficiently smaller in diameter than the valve stem 10 so that the valve stem 10 is, to a degree, force fitted into the cavity 58. In addition, annular ridge 60 may be formed about the tubular upper portion 18 to hold the valve stem 10 in cavity 58. Valve button further includes dispensing channel 62 and terminal orifice 64.

FIG. 6 through 8 shows alternate embodiments of the annular groove. Specifically, the embodiment shown in FIG. 6 includes an annular lip 66 formed on the side wall 18 at the base 30 of the tubular upper portion 12. Further, the annular groove comprises a substantially V-shaped cross-section 67. FIG. 7 shows another embodiment wherein the annular groove comprises a squared-out notched groove 68. FIG. 8 shows still another embodiment including a pair of annular grooves 32 formed in the base 30 of the tubular upper portion 12.

To operate (see FIG. 3) the valve button 56 and the valve stem 10 are depressed, flexing the sealing ring gasket 50 downward wiping the discharge port 16 and side wall 18 of the tubular upper portion 21 clean of product residue. Once below the sealing ring gasket 50, the discharge port 16 communicates with the interior of the dispenser 38 permitting product to flow through the discharge port 16, cylindrical cavity 14, discharge passageway 62 and terminal orifice 64 into the atmosphere.

As shown in FIG. 4, upon release of the valve button 56, the valve stem 10 moves upward causing the inner annular wall 54 of the sealing ring gasket 50 wiping the side wall 18 of the tubular upper portion 12 and the discharge orifice 16 clean of any product residue 70. In the closed or sealed position, FIG. 1, the inner annular wall 54 sealingly engages the side wall 18 below the discharge orifice 16 to prevent any leakage. At the same time, the beveled surface 28 and sealing ledge 21 are forced upward against the button of the sealing ring gasket 50 by spring 26 to form a second seal. In addition, the lower portion of the sealing ring gasket 50 is compressed into the annular groove 32 further sealing the interior of the dispenser from the surrounding atmosphere. The amount of the sealing ring gasket 50 forced into the annular groove 32 is a function of angle 33. Since the sealing ring gasket 50 must wipe the residue from the valve stem 10 as well as seal in the annular groove 32, a medium durometer 70 gasket is preferable.

The alternate embodiments shown in FIGS. 7 and 8 operate similarly to the embodiment described above. The embodiment of FIG. 6 functions as those described above except annular sealing lip 66 pushes into the inner annular wall 54 to enhance the overall sealing of the valve stem 10. Of course, the sealing ring gasket 50 is forced into both annular grooves 32 of FIG. 8.

It will thus be seen that the objects set forth above, among those made apparent from the preceeding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. A double seal cleaning action valve stem in combination with a valve assembly for an aerosol dispenser, said valve stem comprising:

an elongated portion having a cavity formed therein, said valve stem further comprising an enlarged portion integrally attached to said elongated portion and at least partially defined by a diameter greater than the elongated portion; an annular beveled surface disposed in interconnecting relation between said enlarged portion and said elongated portion and inclined outwardly from the base of said elongated portion to said enlarged portion, an annular groove located between said elongated portion and said enlarged portion and extending radially inwardly into said valve stem; a dispensing port formed in a side wall of said elongated portion in communicating relation to said cavity; said valve assembly including a resilient sealing gasket having an aperture formed therein, the side wall of said aperture defining an inner peripheral surface of said sealing gasket, said stem fitted through said aperture so as to movably engage said inner peripheral surface; the outer peripheral portion of said sealing gasket affixed to a remaining portion of said valve assembly such that said inner peripheral surface flexibly engages said valve stem, said sealing gasket normally disposed in a double sealing engagement with both said side wall of said elongated portion and said annular beveled surface to force said sealing gasket radially inwardly into said annular groove, said enlarged portion including a sealing ledge arranged relative to said annular beveled surface and said annular groove to facilitate forcing said sealing gasket into said annular groove thereby defining a seal between said inner peripheral surface and said valve stem; said dispensing port normally disposed in isolated relation, beyond said sealing gasket relative to the aerosol dispenser, whereby movement of said valve stem into said valve assembly causes wiping action of said inner peripheral surface over said dispensing port and said elongated portion.

2. The double seal cleaning action valve stem as in claim 1 further including a second annular groove formed in said side wall of said upper portion below said discharge port.

3. A double seal cleaning action valve stem as in claim 1 further including an annular lip protruding radially outwardly from the base of said upper portion; said annular lip sealingly engaging said sealing gasket.

4. A double seal cleaning action valve stem as in claim 1 wherein said cavity extends into said enlarged lower portion below said discharge port to form a residue receiving chamber.

5. A double seal cleaning action valve stem as in claim 1 wherein said enlarged lower portion includes a protrusion extending from the bottom thereof for receiving a valve stem biasing means.

6. A double seal action valve stem in combination with an aerosol dispenser and valve assembly comprising: an elongated upper portion including a cavity formed therein and an enlarged lower portion, said enlarged lower portion comprising an annular beveled upper surface and a lower enlarged base, said annular upper surface comprising an inclined surface extending outwardly from the base of said upper portion to the upper periphery of said lower enlarged base, a dispensing port formed in the side wall of said upper portion communicating with said cavity, said valve stem being retained within the valve body of the valve assembly, a resilient sealing gasket having a centrally disposed aperture formed therein disposed in the mounting cup of the aerosol dispenser, said elongated upper portion extending through said aperture of said sealing gasket, said sealing gasket mounted within the mounting cup by engagement of a portion of the valve body with the outer periphery of said resilient sealing gasket such that the inner portion of said sealing gasket adjacent said aperture is flexibly mounted in the mounting cup, said resilient sealing gasket engaging said elongated upper portion and said annular beveled upper surface to define a plurality of separate sealing surfaces therebetween, said annular beveled upper surface extending inwardly and terminating on the bottom of said base to form an annular groove between said elongated upper portion and said lower portion, said beveled upper surface deforming said sealing gasket to force said sealing gasket into said annular groove, a sealing ledge arranged relative to said annular beveled upper surface and said annular groove to force said sealing gasket into said annular groove, said dispensing port isolated from the interior of said dispenser when said valve stem is in the sealed position, said resilient sealing gasket disposed to movably engage said side wall and said inclined surface to successively remove residue therefrom upon movement of said valve stem relative to said sealing gasket.

* * * * *